US005181713A

United States Patent [19]

Neugebauer

[11] Patent Number: 5,181,713

[45] Date of Patent: Jan. 26, 1993

[54] PAPER TRAY FOR A COPYING MACHINE

[75] Inventor: Alfred Neugebauer, Stuttgart, Fed. Rep. of Germany

[73] Assignee: Develop Dr. Eisbein GmbH & Co., Fed. Rep. of Germany

[21] Appl. No.: 750,539

[22] Filed: Aug. 27, 1991

[30] Foreign Application Priority Data

Sep. 11, 1990 [DE] Fed. Rep. of Germany ..... 9012932

[51] Int. Cl.[5] ..... B65H 1/12

[52] U.S. Cl. ..... 271/160; 271/164

[58] Field of Search ..... 271/127, 160, 164

[56] References Cited

U.S. PATENT DOCUMENTS

| | | | |
|---|---|---|---|
| 4,280,692 | 7/1981 | Hutchinson | 271/160 |
| 4,307,878 | 12/1981 | Kono | 271/160 |
| 4,405,123 | 9/1983 | Takeyama et al. | 271/160 |
| 4,478,401 | 10/1984 | Shibuya | 271/127 |
| 4,577,850 | 3/1986 | Takeyama et al. | 271/127 |
| 4,728,094 | 3/1988 | Yoshida | 271/127 |
| 5,005,820 | 4/1991 | Leemhuis | 271/160 |

FOREIGN PATENT DOCUMENTS

| | | | |
|---|---|---|---|
| 203031 | 9/1986 | Japan | 271/160 |
| 106246 | 5/1988 | Japan | 271/127 |

*Primary Examiner*—Robert P. Olszewski
*Assistant Examiner*—Steven M. Reiss
*Attorney, Agent, or Firm*—Evenson, Wands, Edwards, Lenahan & McKeown

[57] ABSTRACT

A paper tray arrangement is disclosed for receiving a stack of paper and which is insertable into a receiving device of a copying machine or the like and which includes a supporting plate for the stack of paper and springs applied to the supporting plate to lift the supporting plate off the bottom of the tray. Tensioning apparatus is provided for the springs and a stop of the receiving device is assigned to the tensioning device in such a manner that the spring is tensioned when the paper tray is inserted into the receiving device and is relaxed when the paper tray is taken out of the receiving device.

19 Claims, 1 Drawing Sheet

PAPER TRAY FOR A COPYING MACHINE

BACKGROUND AND SUMMARY OF THE INVENTION

The present invention relates to a paper tray which receives a stack of paper and can be inserted into a receiving device of a copying machine or the like, and which comprises a supporting plate for the stack of paper to which at least one spring is applied which lifts the supporting plate off the bottom of the tray.

Such paper trays are used for holding the paper sheets required for the pertaining machine available in the form of a stack, in which case the stack of sheets is lifted toward a paper feeding roller which, together with elements which follow, carries out the feeding of the paper and the separating of the sheets. Irrespective of the momentary height of the stack of sheets, this stack must always be at the same distance opposite the feeding rollers with the front edge of the uppermost sheet of the stack of paper, the stack facing the paper feeding device. For this reason, the stack of paper is held by a supporting plate which can be lifted off resiliently with respect to the bottom of the tray. For this purpose, it is known to mount one or several compression springs between the supporting plate and the bottom of the tray. When the tray is refilled with paper, the supporting plate must be pressed down against the force of the compression springs and the stack of paper must be inserted at the same time. In order to avoid a constant manual pressing-down during the inserting of the paper, it is known from the U.S. Pat. No. 4,280,692 to mount a locking mechanism for the supporting plate on the bottom of the tray. This locking mechanism locks the supporting plate after it was pressed down once and unlocks automatically when the tray is pushed into the machine.

It is an object of the invention to provide a paper tray of the initially mentioned type which has a simple construction and ensures a simple handling.

In the case of a paper tray of the initially mentioned type, this object is achieved in that a tensioning device is provided for the at least one spring to which a stop of the receiving device is assigned in such a manner that, when the tray is inserted into the receiving device, the spring can be tensioned and, when the tray is removed from the receiving device, it can be relaxed. As a result, the paper tray can be filled without any problems without the requirement of a manual pressing-down against the tensioning force of a spring. The spring, which lifts the supporting plate off the bottom of the tray, does not tighten, specifically automatically, before the paper tray is pushed into the machine.

In a further development of the invention, one tension spring respectively is pivotally connected on both sides to the supporting plate laterally next to the stack of paper. This tension spring can be tensioned and relaxed by means of one assigned tensioning device respectively. As a result, no components have to be mounted between the supporting plate and the bottom of the tray so that no minimum distance must be maintained between the supporting plate and the bottom of the tray. In its lowest position the supporting plate can therefore rest essentially flatly on the bottom of the tray which does not require any indentations, or the like. Since, for ensuring a secure sequence of operations, the supporting plate is arranged at a slight distance to the lateral walls of the tray anyhow, the tension spring arrangement otherwise also does not require any increased space. The arrangement of two tension springs, which are opposite one another, promotes a uniform lifting operation and avoids uneven lifting forces which may lead to a jamming of the paper.

Other objects, advantages and novel features of the present invention will become apparent from the following detailed description of the invention when considered in conjunction with the accompanying drawings.

BRIEF DESCRIPTION OF THE DRAWINGS

FIG. 2 is a view similar to FIG. 1 showing when the tray is completely pushed in.

DETAILED DESCRIPTION OF THE DRAWINGS

Figure 1:
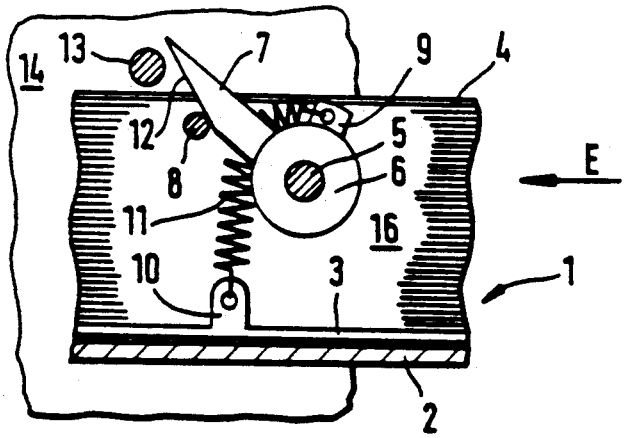
FIG. 1 is a sectional schematic lateral view of a tray constructed in accordance with a preferred embodiment of the present invention and filled with a stack of paper while being pushed into the receiving device of a copying machine, the lateral wall of the tray having been omitted for illustration purposes.

FIG. 1 illustrates a section of a tray 1 at the start of the slide-in operation into a schematically outlined receiving device 14 of a copying machine (slide-in direction E). For rendering the parts visible which are significant to the invention, the lateral wall of the tray 1, which is in the front in the figure, is not shown.

A supporting plate in the form of a spring-applied plate 3 rests essentially flatly on a bottom 2 of the tray 1 and, at its end, which is in the rear in the slide-in direction (E), is pivotally connected to the bottom 2 of the tray and can be lifted by means of its front end, as will be described in the following. Paper, in the form of a stack of sheets, is placed on the spring-applied plate 3. In FIG. 1, the tray 1 is completely filled by means of a new stack of sheets 16 so that the stack of sheets 16 extends almost to the upper edge of the tray 1 and covers the opposite lateral wall 4 of the tray 1, in the view of FIG. 1, almost to its upper edge. The spring-applied plate 3, in a conventional manner, at its end which is in the rear in the slide-in direction (E), is pivotally connected to the bottom 2 of the tray and, in each case, holds the uppermost sheet against the corner separators and in within the catching range of a feeding roller.

For the lifting of the spring-applied plate 3, two tension springs 11 are used which are mounted in a symmetrically opposite manner on the interior side of the two lateral walls of the tray 1 and of which only one is shown. On the one side, the tension springs 11 are fixed in each case to a bracket 10 which is bent upwards at a right angle on the lateral edge of the spring-applied plate 3, and on the other side, the tension springs 11 are fixed on a holding device mounted on the lateral wall of the tray. The holding device is constructed as a disk 6 which, by means of a shaft 5, while being rotatable about it, is mounted on the lateral wall of the tray 1. The disk 6 does not have to be circular, as shown, but may also be cam-shaped with radius that is not constant along the circumference. The tension spring 11 is fixed on the circumference of the disk 6 on a radial lengthening or bracket 9. In a manner which is not shown, the circumference of the disk 6 also has a semicircular groove in which the tension spring 11 is guided which extends along a portion of the circumference and is therefore laterally secured. In addition, the disk 6 used for the holding and tensioning of the tension spring 11 has a radially projecting lever 7 which is chamfered on its side facing the slide-in direction (E) and, as a result, forms a wedge-shaped stop face 12 at its end. Also, a stop pin 8 is fixedly mounted on the lateral wall of the tray. In the shown position, in which the tray 1 is not completely slid into the receiving device 14, the lever 7 rests against the stop pin 8 with its stop surface 12, whereby the position of the disk 6 is defined when the tray 1 is not pushed in. In the illustrated position of FIG. 1—lever 7 resting against the stop pin 8 and spring-applied plate 3 resting on the bottom 2 of the tray—the spring 11 is largely relaxed. In order to exercise a sufficient lift-off force in the tensioned condition, the spring rate of the tension springs 11 and the radius of the disk 6 which determines the spring tensioning path must be selected in an appropriate manner.

Figure 2:
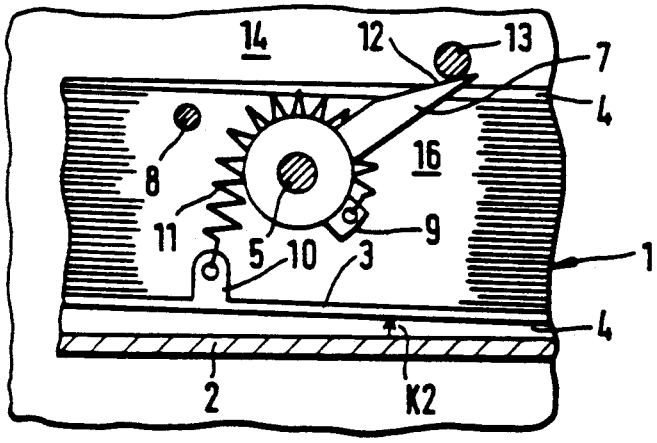

FIG. 1 also illustrates a stop pin 13 which is stationarily mounted in the receiving device 14 of the copying machine. It can be recognized, in this case, that, when the tray 1 is slid in farther in the slide-in direction (E), the disk 6, by way of its radial lever 7, interacts with this stationary stop pin 13. The interaction consists of the fact that, when the tray 1 slid in farther, the lever 7 moves against the stop pin 13 with its stop face 12 and subsequently causes a rotating movement of the disk 6, in which case the lever 7 moves away from the stop pin 8 until, when the tray is completely slid in, the position is reached which is illustrated in FIG. 2. In this case, it is important that the force, which is now exercised by the tensioned tension spring 11, is not directed such that it counteracts the slide-in movement in order to avoid an undesirable moving-out of the tray from its end position. This is achieved in that the rotating shaft 5 is situated deeper in the receiving device than the stop pin 13, and the lever 7 is rotated beyond its vertical position s that the force exercised by the stop pin 13 on the paper tray 1 has only a negligible component against the slide-in direction (E). This favorable arrangement saves the use of an additional locking device for the paper tray 1.

As illustrated in FIG. 2, the increase of the spring length is achieved by the fact that, because of the rotating movement of the disk 6 and thus of the lengthening 9, the spring 11 is now guided along a larger portion of the circumference of the disk 6. The resulting tensioning of the tension spring 11 has the purpose of lifting the spring-applied plate 3 and pressing the stack of sheets 16 against the corner separators which are not shown. By means of the tensioning force of the spring 11, the spring-applied plate 3 is lifted by a slight angle (K2) which is determined by the position of the not show rotating shaft on the bottom 2 of the tray for the spring-applied plate 3 and the resting of the stack 16 of paper against the corner separators.

In the course of the operation, the thickness of the stack 16 of sheets continues to decrease, thereby correspondingly changing the position of the spring-applied plate 3 relative to the bottom 2 of the tray.

Figure 3:
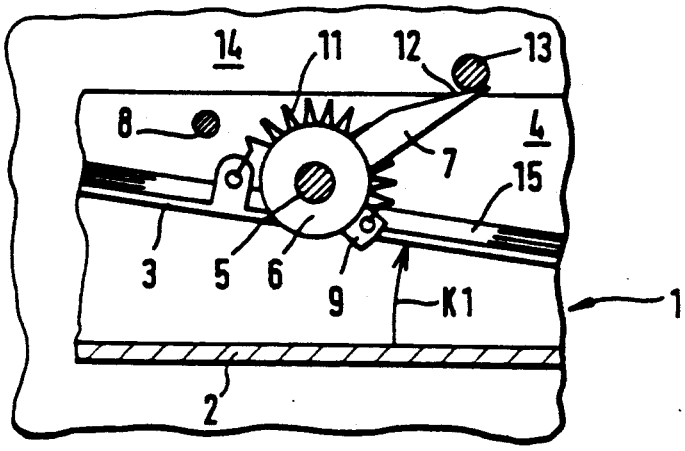
FIG. 3 is a view similar to FIG. 2 showing a stack of paper which is now of only a low height.

FIG. 3 represents a situation in which only a stack 15 of paper of a low height is present in the tray 1. The tensioning force of the spring 11 and the decreasing height of the paper stack 15 have had the result that the spring-applied plate 3 is now already lifted by a larger angle (K1) with respect to the bottom 2 of the tray so that the area of the front-side corners of the uppermost sheet remains pressed against the corner separators. The spring 11 is selected such that, also in the position shown in FIG. 3 in which the spring length is shortened again in comparison to the position in FIG. 2 by the lifting-off also of the lengthening 10, it still offers the necessary tensile force for the pressing of also the last sheet of the stack 15 onto the corner separators and thus for the holding of this sheet in the ready-position for the paper feeding roller.

When the tray 1 is pulled out, the disk 6 moves back into the position shown in FIG. 1. This is caused, on the one hand, by the downward directed force of the weight of the spring-applied plate 3 and of sheets of paper which may possibly have remained on the spring-applied plate 3 and, on the other hand, by the release of the return rotating direction by the stop pin 13. Therefore, when the tray 1 is taken out, the position of the spring-applied plate 3 and the disk 6 shown in FIG. 1 will already exist. During the filling with the stack 16 of sheets, this stack can therefore simply be inserted. The spring-applied plate 3 therefore rests flatly against the bottom 2 of the tray and does not have to be held down against the force of a spring. The disk 6, which interacts with the stop pin 13 by way of the lever 7, in contrast, has the effect that the essential tensile force of the spring 11 does not become effective before the tray 1 is pushed into the receiving device 14. The refilling of the tray 1 is therefore significantly facilitated.

Because of the tension springs 11 mounted on the lateral walls of the tray 1, the mounting of any type of component between the spring-applied plate 3 and the bottom 2 of the tray is eliminated so that the overall height of the tray is essentially only determined by the thickness of the tray bottom 2, of the spring-applied plate 3 and of the height of the stack 16 of sheets. A space between the spring-applied plate 3 and the tray bottom 2 for receiving a compression spring or locking elements which further increases the overall height is not necessary in this case.

By means of the symmetrical arrangement of two tension springs on both lateral walls of the tray 1, the lifting of the spring-applied plate 3 and of the stack 16, 15 of paper disposed on it takes place in a uniform manner so that no difficulties occur during the feeding of the paper.

It is clear that, in addition to the shown embodiment of the holding device in the form of a disk 6, a movable holding device of a different type may also be provided on a lateral wall of the tray which, when the tray 1 is slid in, is moved by means of a stop of the copying machine. Thus, for example, a holding device, which carries the lengthening or bracket 9 for the spring fastening, may be vertically movably arranged on a lateral wall and interact in such a manner with a stop in the receiving device constructed as a wedge surface that the holding device, when the tray is pushed in, by means of the pushing onto the wedge surface, is moved vertically upward and thus a pertaining tension spring is tensioned. Combinations of rotational and translational movements are also possible for the holding device connected with a lateral wall of the tray 1.

In each case, it must be ensured that, on the on hand, a sufficiently large spring tensioning path is made available for exercising a sufficiently high tension force and that, on the other hand, the spring forces which are operative when the tray is pushed in, do not load the latter against the slide-in direction and possibly move it out of the end position. If necessary, this may also be prevented by an additional spring locking.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A paper tray arrangement for receiving a stack of paper and which is insertable into a receiving device of a copying machine, comprising:

a supporting plate for the stack of paper, at least one spring applied directly to the supporting plate to lift the supporting plate off the bottom of the tray, tensioning apparatus for the at least one spring, and a stop on the receiving device engageable with the tensioning apparatus in such a manner that the spring is progressively tensioned only when the paper tray is inserted into the receiving device and is progressively relaxed only when the paper tray is taken out of the receiving device.

2. A paper tray arrangement according to claim 1, wherein said at least one spring includes one tension spring respectively pivotally connected on both sides to the supporting plate laterally next to the paper stack, and wherein said tensioning apparatus includes a respectively assigned tensioning apparatus for each tension spring.

3. A paper tray arrangement according to claim 2, wherein each tensioning device includes a disk which is pivotally disposed in a pertaining lateral wall of the paper tray and to the circumference of which one end of the tension spring respectively is fastened.

4. A paper tray arrangement according to claim 1, wherein the tensioning apparatus includes a disk which is pivotally disposed in a pertaining lateral wall of the paper tray and to the circumference of which one end of the tension spring respectively is fastened.

5. A paper tray arrangement according to claim 4, wherein the disk is equipped with a tension lever which projects essentially radially away from the disk and to which the stop of the receiving device is assigned.

6. A paper tray arrangement according to claim 1, wherein lateral walls of the paper tray are each provided with one stop respectively for limiting the movement of the tensioning apparatus in a relaxing direction.

7. A paper tray arrangement for receiving a stack of paper and which is insertable into a receiving device of a copying machine comprising:

a supporting plate for the stack of paper, at least one spring applied to the supporting plate to lift the supporting plate off the bottom of the tray, tensioning apparatus for the at least one spring, and a stop of the receiving device assigned to the tensioning apparatus in such a manner that the spring is tensioned when the paper tray is inserted into the receiving device and is relaxed when the paper tray is taken out of the receiving device, wherein said at least one spring includes one tension spring respectively pivotally connected on both sides to the supporting plate laterally next to the paper stack, and wherein said tensioning apparatus includes a respectively assigned tensioning apparatus for each tension spring.

8. A paper tray arrangement according to claim 7, wherein each tensioning apparatus includes a disk which is pivotally disposed in a pertaining lateral wall of the paper tray and to the circumference of which one end of the tension spring respectively is fastened.

9. A paper tray arrangement according to claim 8, wherein the circumference of the respective disks is provided with a guide groove for the associated tension spring.

10. A paper arrangement according to claim 9, wherein the lateral walls of the paper tray are each provided with one stop respectively which is assigned to a tension lever of the associated disk and limits the movement in the relaxing direction.

11. A paper tray arrangement according to claim 8, wherein each disk is equipped with a tension lever which projects essentially radially away from the disk and to which a stop of the receiving device is assigned.

12. A paper tray arrangement according to claim 11, wherein the circumference of the respective disks is provided with a guide groove for the associated tension spring.

13. A paper tray arrangement according to claim 11, wherein the lateral walls of the paper tray are each provided with one stop respectively which is assigned to a tension lever of the associated disk and limits the movement in the relaxing direction.

14. A paper tray arrangement for receiving a stack of paper and which is insertable into a receiving device of a copying machine, comprising:

a supporting plate for the stack of paper, at least one spring applied to the supporting plate to lift the supporting plate off the bottom of the tray, tensioning apparatus for the at least one spring, and a stop of the receiving device assigned to the tensioning apparatus in such a manner that the spring is tensioned when the paper tray is inserted into the receiving device and is relaxed when the paper tray is taken out of the receiving device, wherein the tensioning apparatus includes a disk which is pivotally disposed in a pertaining lateral wall of the paper tray and to the circumference of which one end of the tension spring respectively is fastened.

15. A paper tray arrangement according to claim 14, wherein the circumference of the disk is provided with a guide groove for the tension spring.

16. A paper tray arrangement according to claim 14, wherein the disk is equipped with a tension lever which projects essentially radially away from the disk and to which the stop of the receiving device is assigned.

17. A paper tray arrangement for receiving a stack of paper and which is insertable into a receiving device of a copying machine, comprising:

a supporting plate for the stack of paper, at least one spring applied directly to the supporting plate to lift the supporting plate off the bottom of the tray, tensioning apparatus for the at least one spring, and a stop on the receiving device engageable with the tensioning apparatus so that the spring is automatically tensioned only when the paper tray is inserted into the receiving device and is automatically relaxed only when the paper tray is removed from the receiving device, with said automatic relaxation of the spring being effected without any steps other than removal of the paper tray from the receiving device and consequent disengagement of the stop and the tensioning apparatus.

18. A paper tray arrangement according to claim 17, wherein said at least one spring includes one tension spring respectively pivotally connected on both sides to the supporting plate laterally next to the paper stack, and wherein said tensioning apparatus includes a respectively assigned tensioning apparatus for each tension spring.

19. A paper tray arrangement according to claim 17, wherein the tensioning apparatus includes a disk which is pivotally disposed in a pertaining lateral wall of the paper tray and to the circumference of which one end of the tension spring respectively is fastened.

* * * * *